US009900723B1

(12) United States Patent
Choisel et al.

(10) Patent No.: US 9,900,723 B1
(45) Date of Patent: Feb. 20, 2018

(54) MULTI-CHANNEL LOUDSPEAKER MATCHING USING VARIABLE DIRECTIVITY

(71) Applicant: Apple Inc., Cupertino, CA (US)

(72) Inventors: Sylvain J. Choisel, Cupertino, CA (US); Afrooz Family, Emerald Hills, CA (US); Martin E. Johnson, Los Gatos, CA (US); Tomlinson M. Holman, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/300,120

(22) Filed: Jun. 9, 2014

Related U.S. Application Data

(60) Provisional application No. 62/004,111, filed on May 28, 2014.

(51) Int. Cl.
*H04S 7/00* (2006.01)

(52) U.S. Cl.
CPC ..... *H04S 7/305* (2013.01); *H04S 7/302* (2013.01)

(58) Field of Classification Search
CPC ..... H04S 7/305; H04S 7/302; H04S 7/30
See application file for complete search history.

(56) References Cited

U.S. PATENT DOCUMENTS

| | | | | |
|---|---|---|---|---|
| 6,243,476 | B1 | 6/2001 | Garner | |
| 7,515,719 | B2 | 4/2009 | Hooley et al. | |
| 7,860,260 | B2 | 12/2010 | Kim et al. | |
| 8,130,968 | B2 | 3/2012 | Tamaru et al. | |
| 8,135,143 | B2 | 3/2012 | Ishibashi et al. | |
| 8,223,992 | B2 | 7/2012 | Suzuki et al. | |
| 2004/0208324 | A1 | 10/2004 | Cheung et al. | |
| 2008/0089522 | A1 | 4/2008 | Baba et al. | |
| 2009/0129602 | A1 | 5/2009 | Konagai et al. | |
| 2011/0058677 | A1* | 3/2011 | Choi | H04R 5/04 381/17 |
| 2012/0020480 | A1 | 1/2012 | Visser et al. | |
| 2013/0223658 | A1 | 8/2013 | Betlehem et al. | |
| 2015/0223002 | A1* | 8/2015 | Mehta | H04S 7/30 381/303 |
| 2015/0271620 | A1* | 9/2015 | Lando | H04S 5/005 381/18 |

FOREIGN PATENT DOCUMENTS

WO WO-2012093345 7/2012

* cited by examiner

*Primary Examiner* — Sonia Gay
(74) *Attorney, Agent, or Firm* — Womble Bond Dickinson (US) LLP

(57) ABSTRACT

An audio system that maintains an identical or similar direct-to-reverberant ratio for sound produced from a first speaker array and sound produced by a second speaker array at the location of a listener is described. The audio system may determine characteristics of the first and second speaker arrays, including the distance between the first speaker array and the listener and the second speaker array and the listener. Based on these characteristics, beam patterns are selected for one or more of the speaker arrays such that sound produced by each of the speaker arrays maintains a preferred direct-to-reverberant ratio at the location of the listener.

27 Claims, 10 Drawing Sheets

MULTI-CHANNEL LOUDSPEAKER MATCHING USING VARIABLE DIRECTIVITY

RELATED MATTERS

This application claims the benefit of the earlier filing date of U.S. provisional application No. 62/004,111, filed May 28, 2014.

FIELD

An audio device adjusts beam patterns used by two or more loudspeakers in an audio system to achieve a preferred direct-to-reverberant ratio of sound produced by each loudspeaker at a listening position. Accordingly, each loudspeaker may be assigned a beam pattern that achieves the preferred direct-to-reverberant ratio at the listening position to maintain a consistency for sound in the system. Other embodiments are also described.

BACKGROUND

The optimal reproduction of multichannel audio content (e.g., stereo audio, 5.1 channel audio, 7.1 channel audio) imposes restrictions on loudspeaker placement relative to a listening position. For instance, some audio systems recommend preferred angles and distances between loudspeakers to achieve optimal performance. These measures ensure that the spatial imaging produced by loudspeakers is in line with the intent during a mixing phase.

However, in a practical situation it is not always possible (e.g., room layout constraints) or desired (e.g., aesthetical preferences) to place loudspeakers at their recommended distances and angles. To compensate for non-ideal placement, some surround sound receivers implement a gain and delay compensation technique. This technique aims at ensuring that the sounds from all loudspeakers reach a listening position at the same time and level. More advanced systems also offer the possibility to compensate for timbral differences between loudspeakers by including an equalization system. However, even when time, level and spectrum are equal at a listening position, some audible differences remain, which are the result of inconsistent direct-to-reverberant ratios from sound produced by each loudspeaker.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

SUMMARY

An audio system is disclosed that includes an audio source and two or more speaker arrays. The speaker arrays may be configured to generate one or more different beam patterns. For example, the speaker arrays may be capable of producing omnidirectional, cardioid, second order, and fourth order beam patterns based on signals received from the audio source. Each of the beam patterns generated by the speaker arrays may generate separate direct-to-reverberant ratios at the location of a listener. The direct-to-reverberant ratio may be defined as the ratio of sound energy received directly from a speaker array (e.g., sound energy received at the location of the listener without reflection) to sound energy received indirectly from the speaker array (e.g., sound energy received at the location of the listener after reflection in a listening area). The direct-to-reverberant ratio may be dependent on several factors, including the directivity index of a beam pattern, the distance between a speaker array and the listener, room size and absorption.

In one embodiment, the audio system may determine a preferred direct-to-reverberant ratio. This preferred direct-to-reverberant ratio may be used by two or more speaker arrays in the audio system to produce sound for a listener. For example, the audio system may select beam patterns for each of the speaker arrays based on the distance between each speaker array and the listener. These beam patterns may be selected such that the direct-to-reverberant ratio at the location of a listener for sound produced by each of the speaker arrays is equal or within a predefined threshold to the preferred direct-to-reverberant ratio. By matching direct-to-reverberant ratios for sound produced by multiple speaker arrays, the audio system described herein ensures a more consistent listening experience for the listener.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments are described with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1A:
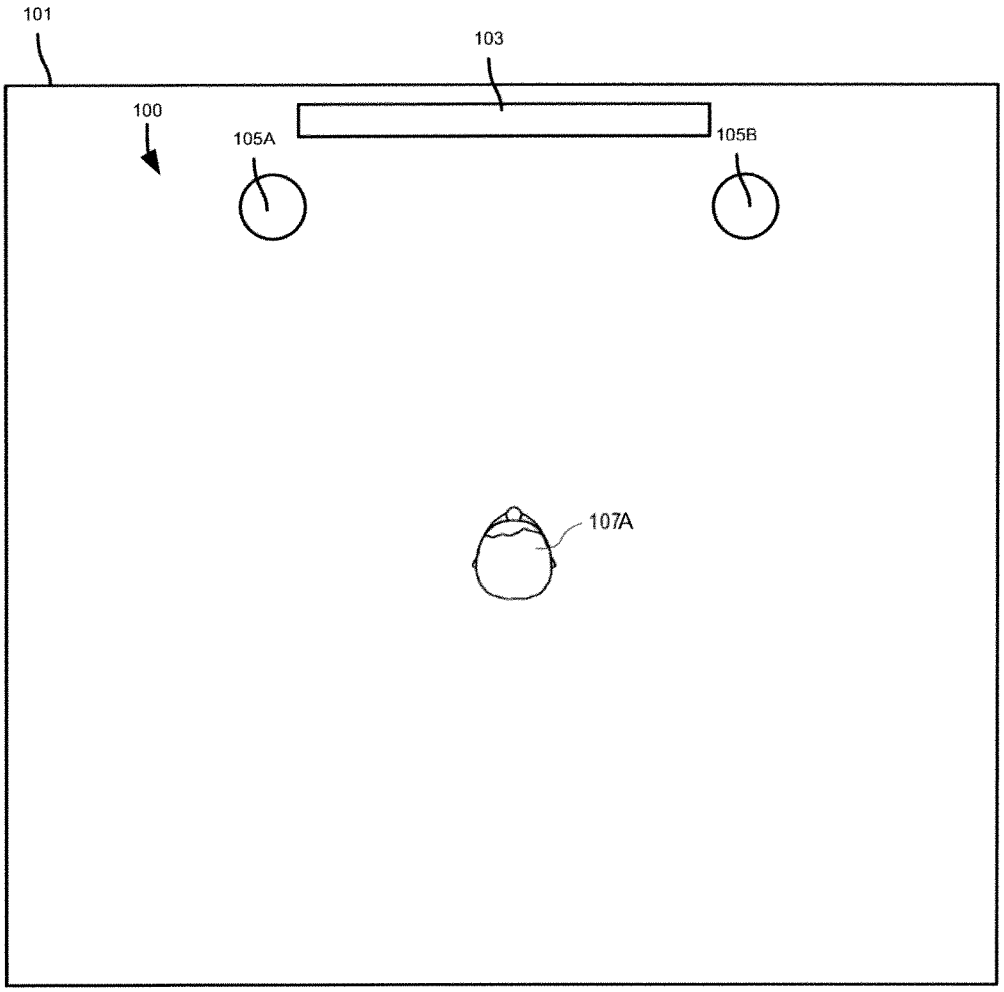
FIG. 1A shows a view of an audio system with two speaker arrays according to one embodiment.

FIG. 1A shows a view of an audio system 100 within a listening area 101. The audio system 100 may include an audio source 103 and a set of speaker arrays 105. The audio source 103 may be coupled to the speaker arrays 105 to drive individual transducers 109 in the speaker array 105 to emit various sound beam patterns for the listener 107. In one embodiment, the speaker arrays 105 may be configured to generate audio beam patterns that represent individual channels for one or more pieces of sound program content. Playback of these pieces of sound program content may be aimed at the listener 107 within the listening area 101. For example, the speaker arrays 105 may generate and direct beam patterns that represent front left, front right, and front center channels for a first piece of sound program content to the listener 107. In one embodiment, the audio source 103 and/or the speaker arrays 105 may be driven to maintain a similar or identical direct-to-reverberant ratio for sound produced by each of the speaker arrays 105 at the location of the listener 107. The techniques for driving these speaker arrays 105 to maintain this similar/identical direct-to-reverberant ratio will be described in greater detail below.

As shown in FIG. 1A, the listening area 101 is a room or another enclosed space. For example, the listening area 101 may be a room in a house, a theatre, etc. In each embodiment, the speaker arrays 105 may be placed in the listening area 101 to produce sound that will be perceived by the listener 107.

Figure 2A:
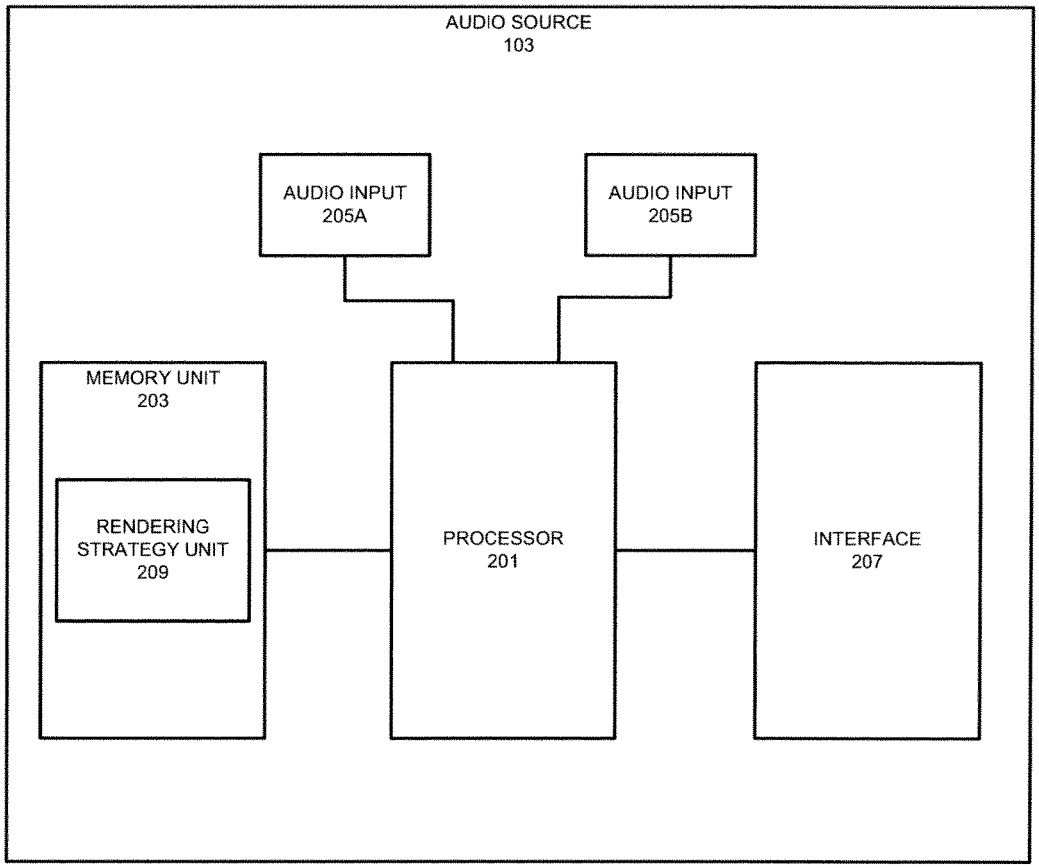
FIG. 2A shows a component diagram of an example audio source according to one embodiment.

FIG. 2A shows a component diagram of an example audio source 103 according to one embodiment. As shown in FIG. 1A, the audio source 103 is a television; however, the audio source 103 may be any electronic device that is capable of transmitting audio content to the speaker arrays 105 such that the speaker arrays 105 may output sound into the listening area 101. For example, in other embodiments the audio source 103 may be a desktop computer, a laptop computer, a tablet computer, a home theater receiver, a set-top box, a personal video player, a DVD player, a Blu-ray player, a gaming system, and/or a mobile device (e.g., a smartphone). Although shown in FIG. 1A with a single audio source 103, in some embodiments the audio system 100 may include multiple audio sources 103 that are coupled to the speaker arrays 105 to output sound corresponding to separate pieces of sound program content.

As shown in FIG. 2A, the audio source 103 may include a hardware processor 201 and/or a memory unit 203. The processor 201 and the memory unit 203 are generically used here to refer to any suitable combination of programmable data processing components and data storage that conduct the operations needed to implement the various functions and operations of the audio source 103. The processor 201 may be an applications processor typically found in a smart phone, while the memory unit 203 may refer to microelectronic, non-volatile random access memory. An operating system may be stored in the memory unit 203 along with application programs specific to the various functions of the audio source 103, which are to be run or executed by the processor 201 to perform the various functions of the audio source 103. For example, a rendering strategy unit 209 may be stored in the memory unit 203. As will be described in greater detail below, the rendering strategy unit 209 may be used to generate beam attributes for each channel of one or more pieces of sound program content to be played by the speaker arrays 105 in the listening area 101. For instance, the beam attributes may include beam types for sound beams produced by each of the speaker arrays 105 (e.g., omnidirectional, cardioid, second order, and fourth order).

In one embodiment, the audio source 103 may include one or more audio inputs 205 for receiving audio signals from external and/or remote devices. For example, the audio source 103 may receive audio signals from a streaming media service and/or a remote server. The audio signals may represent one or more channels of a piece of sound program content (e.g., a musical composition or an audio track for a movie). For example, a single signal corresponding to a single channel of a piece of multichannel sound program content may be received by an input 205 of the audio source 103. In another example, a single signal may correspond to multiple channels of a piece of sound program content, which are multiplexed onto the single signal.

In one embodiment, the audio source 103 may include a digital audio input 205A that receives digital audio signals from an external device and/or a remote device. For example, the audio input 205A may be a TOSLINK connector or a digital wireless interface (e.g., a wireless local area network (WLAN) adapter or a Bluetooth receiver). In one embodiment, the audio source 103 may include an analog audio input 205B that receives analog audio signals from an external device. For example, the audio input 205B may be a binding post, a Fahnestock clip, or a phono plug that is designed to receive and/or utilize a wire or conduit and a corresponding analog signal from an external device.

Although described as receiving pieces of sound program content from an external or remote source, in some embodiments pieces of sound program content may be stored locally on the audio source 103. For example, one or more pieces of sound program content may be stored within the memory unit 203.

Figure 1B:
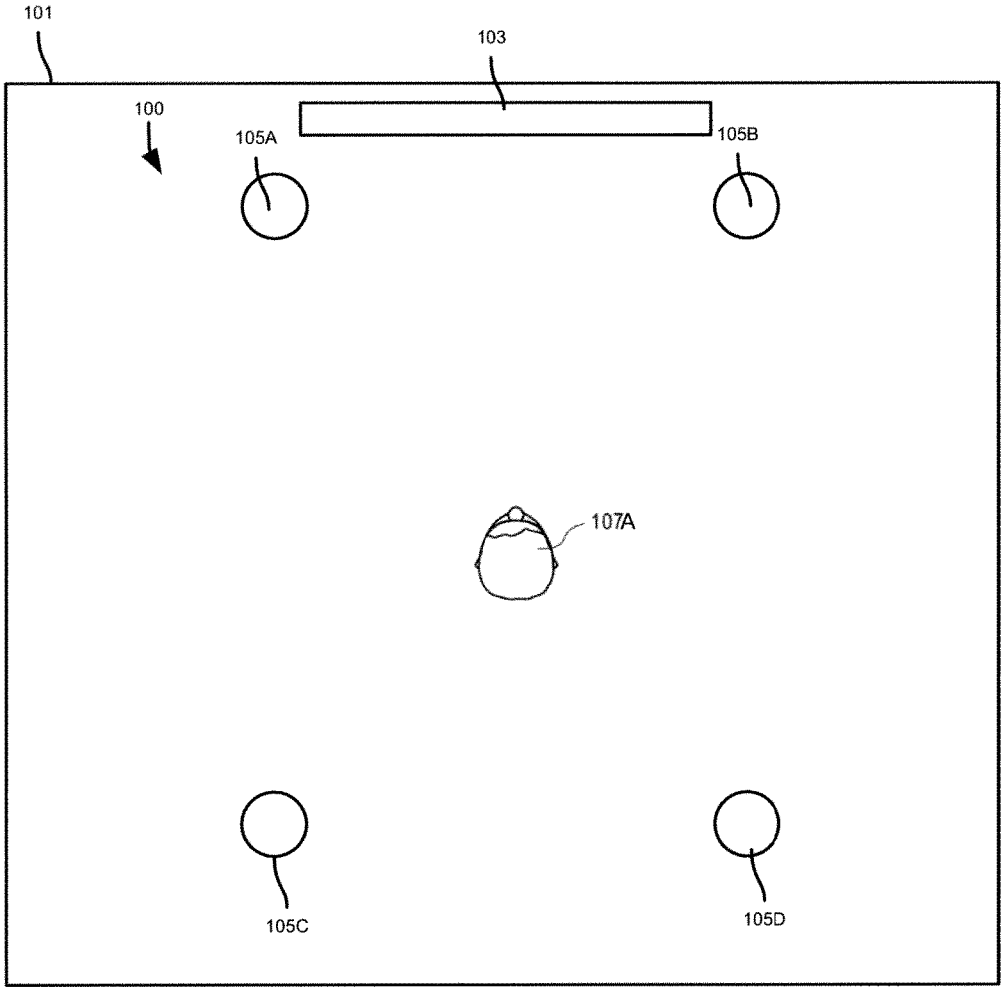
FIG. 1B shows a view of an audio system with four speaker arrays according to one embodiment.

In one embodiment, the audio source 103 may include an interface 207 for communicating with the speaker arrays 105 and/or other devices (e.g., remote audio/video streaming services). The interface 207 may utilize wired mediums (e.g., conduit or wire) to communicate with the speaker arrays 105. In another embodiment, the interface 207 may communicate with the speaker arrays 105 through a wireless connection as shown in FIG. 1A and FIG. 1B. For example, the network interface 207 may utilize one or more wireless protocols and standards for communicating with the speaker arrays 105, including the IEEE 802.11 suite of standards, cellular Global System for Mobile Communications (GSM) standards, cellular Code Division Multiple Access (CDMA) standards, Long Term Evolution (LTE) standards, and/or Bluetooth standards.

Figure 2B:
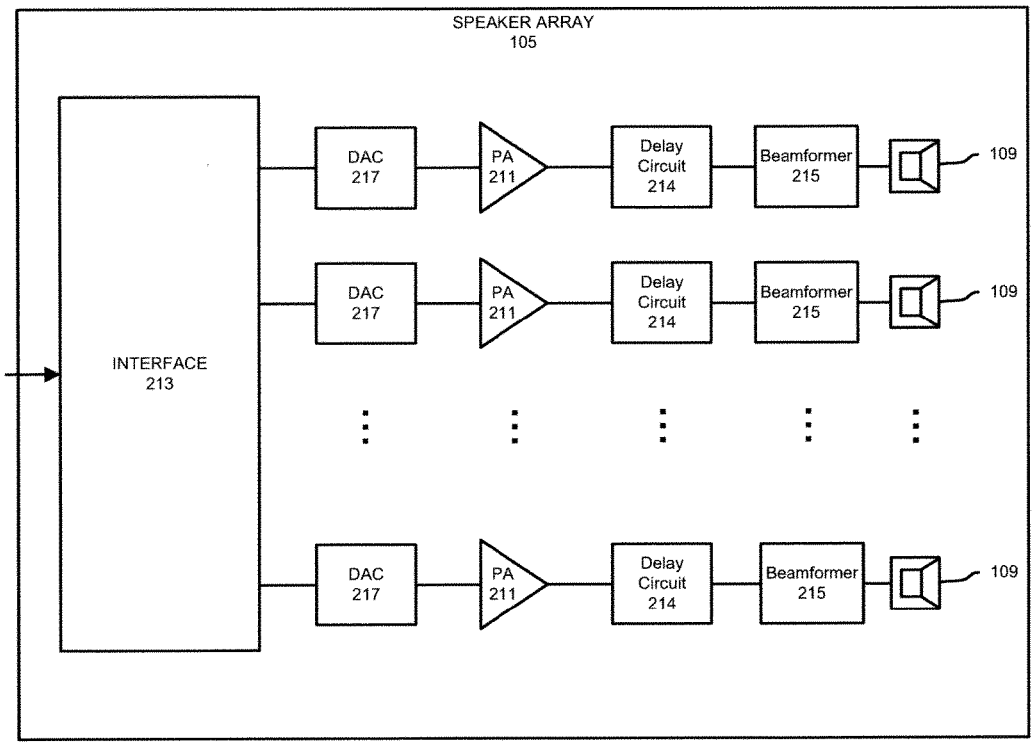
FIG. 2B shows a component diagram of a speaker array according to one embodiment.

FIG. 2B shows a component diagram of a speaker array 105 according to one embodiment. As shown in FIG. 2B, the speaker array 105 may receive audio signals corresponding to audio channels from the audio source 103 through a corresponding interface 213. These audio signals may be used to drive one or more transducers 109 in the speaker arrays 105. As with the interface 207, the interface 213 may utilize wired protocols and standards and/or one or more wireless protocols and standards, including the IEEE 802.11 suite of standards, cellular Global System for Mobile Communications (GSM) standards, cellular Code Division Multiple Access (CDMA) standards, Long Term Evolution (LTE) standards, and/or Bluetooth standards. In some embodiments, the speaker array 105 may include digital-to-analog converters 217, power amplifiers 211, delay circuits 214, and beamformers 215 for driving transducers 109 in the speaker arrays 105. The digital-to-analog converters 217, power amplifiers 211, delay circuits 214, and beamformers 215 may be formed/implemented using any set of hardware circuitry and/or software components. For example, the beamformers 215 may be comprised of a set of finite impulse response (FIR) filters and/or one or more other filters that control the relative magnitudes and phases between the transducers.

Although described and shown as being separate from the audio source 103, in some embodiments, one or more components of the audio source 103 may be integrated within the speaker arrays 105. For example, one or more of the speaker arrays 105 may include the hardware processor 201, the memory unit 203, and the one or more audio inputs 205. In this example, a single speaker array 105 may be designated as a master speaker array 105. This master speaker array 105 may distribute sound program content and/or control signals (e.g., data describing beam pattern types) to each of the other speaker arrays 105 in the audio system 100.

Figure 3A:
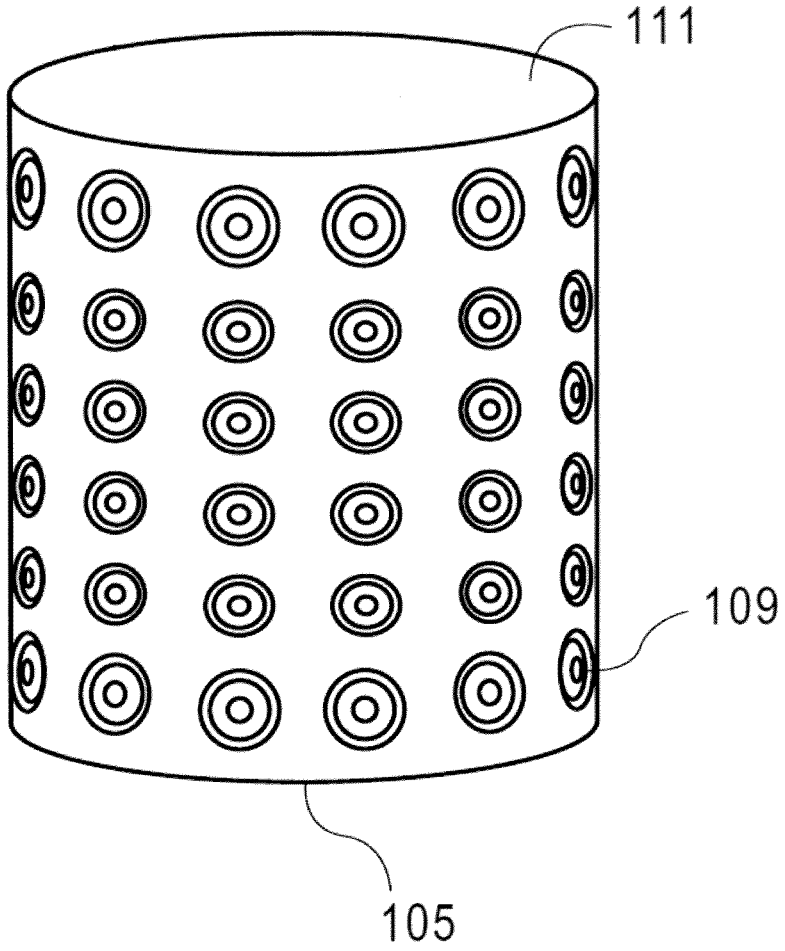
FIG. 3A shows a side view of one speaker array according to one embodiment.

FIG. 3A shows a side view of one of the speaker arrays 105 according to one embodiment. As shown in FIG. 3A, the speaker arrays 105 may house multiple transducers 109 in a curved cabinet 111. As shown, the cabinet 111 is cylindrical; however, in other embodiments the cabinet 111 may be in any shape, including a polyhedron, a frustum, a cone, a pyramid, a triangular prism, a hexagonal prism, or a sphere.

Figure 3B:
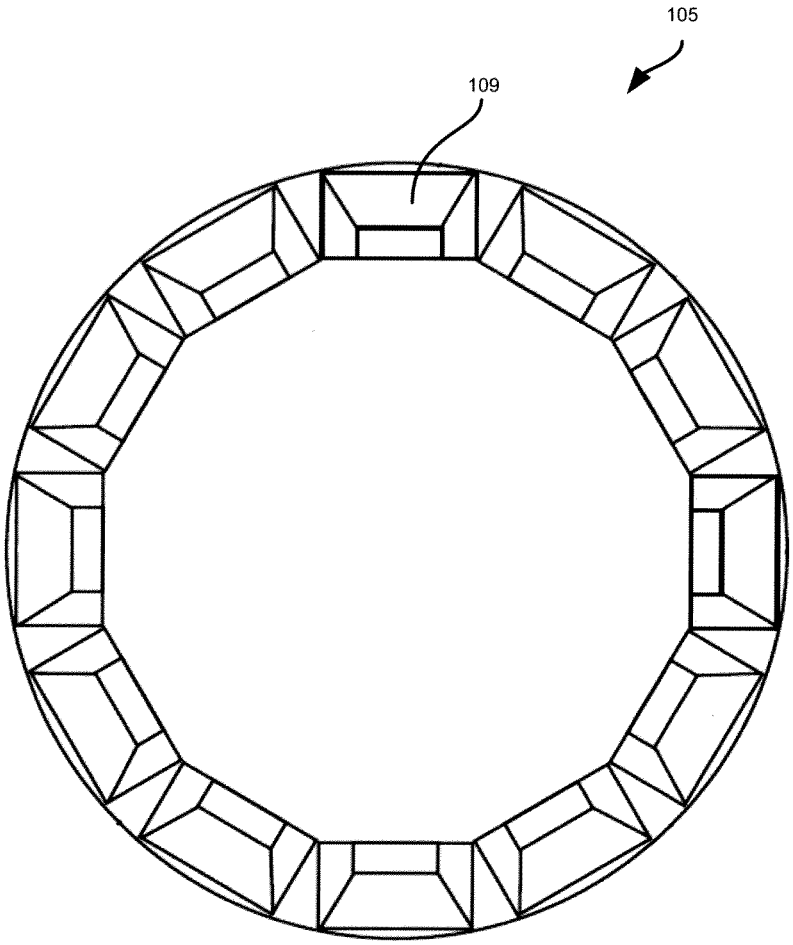
FIG. 3B shows an overhead, cutaway view of a speaker array according to one embodiment.

FIG. 3B shows an overhead, cutaway view of a speaker array 105 according to one embodiment. As shown in FIGS. 3A and 3B, the transducers 109 in the speaker array 105 encircle the cabinet 111 such that the transducers 109 cover the curved face of the cabinet 111. The transducers 109 may be any combination of full-range drivers, mid-range drivers, subwoofers, woofers, and tweeters. Each of the transducers 109 may use a lightweight diaphragm, or cone, connected to a rigid basket, or frame, via a flexible suspension that constrains a coil of wire (e.g., a voice coil) to move axially through a cylindrical magnetic gap. When an electrical audio signal is applied to the voice coil, a magnetic field is created by the electric current in the voice coil, making it a variable electromagnet. The coil and the transducers' 109 magnetic system interact, generating a mechanical force that causes the coil (and thus, the attached cone) to move back and forth, thereby reproducing sound under the control of the applied electrical audio signal coming from an audio source, such as the audio source 103. Although electromagnetic dynamic loudspeaker drivers are described for use as the transducers 109, those skilled in the art will recognize that other types of loudspeaker drivers, such as piezoelectric, planar electromagnetic and electrostatic drivers are possible.

Figure 4:
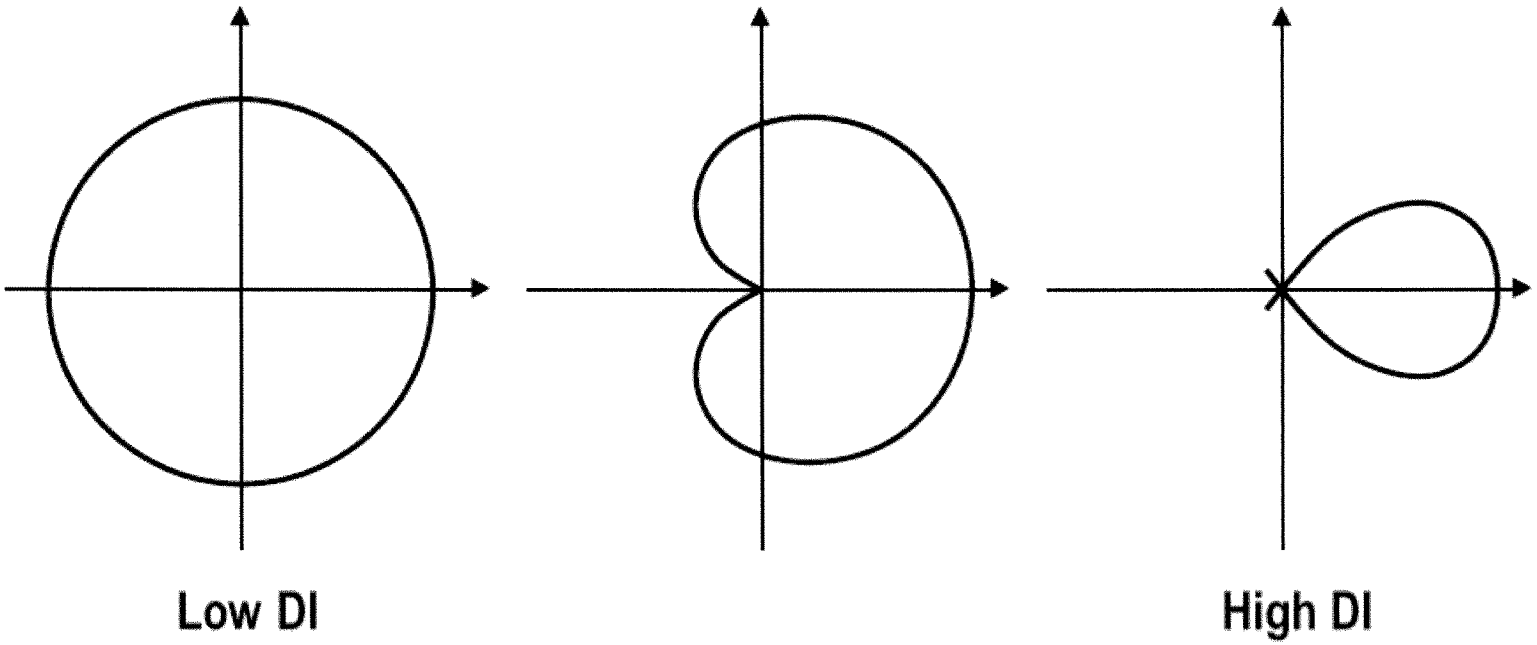
FIG. 4 shows a set of beam patterns that may be produced by the speaker arrays according to one embodiment.

Each transducer 109 may be individually and separately driven to produce sound in response to separate and discrete audio signals received from an audio source 103. By allowing the transducers 109 in the speaker arrays 105 to be individually and separately driven according to different parameters and settings (including delays and energy levels), the speaker arrays 105 may produce numerous directivity/beam patterns that accurately represent each channel of a piece of sound program content output by the audio source 103. For example, in one embodiment, the speaker arrays 105 may individually or collectively produce omnidirectional, cardioid, second order, and fourth order beam patterns. FIG. 4 shows a set of beam patterns that may be produced by the speaker arrays 105. As shown, the directivity index of the beam patterns in FIG. 4 increase from left to right.

Although shown in FIG. 1A as including two speaker arrays 105, in other embodiments a different number of speaker arrays 105 may be used. For example, as shown in FIG. 1B four speaker arrays 105 may be used within the listening area 101. Further, although described as similar or identical styles of speaker arrays 105, in some embodiments the speaker arrays 105 in the audio system 100 may have different sizes, different shapes, different numbers of transducers, and/or different manufacturers.

Further, as noted above, although the speaker arrays 105 shown in the FIGS. 1A, 1B, 3A, and 3B are shown with a cylindrical cabinet 111 and uniformly spaced transducers 109, in other embodiments, the speaker arrays 105 may be differently sized and transducers 109 may be differently arranged within the cabinet 111. Accordingly, the style of the speaker arrays 105 shown and described herein is merely illustrative and in other embodiments, different types and styles of speaker arrays 105 may be used.

Figure 5:
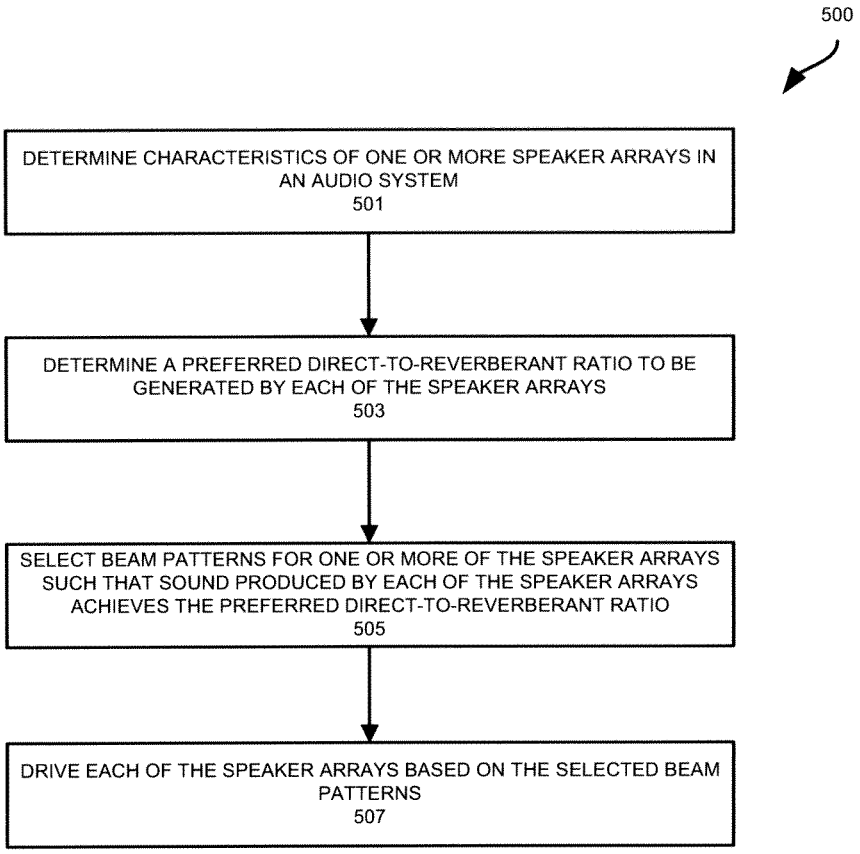
FIG. 5 shows a method for driving one or more speaker arrays to generate sound with similar or identical direct-to-reverberant ratios at the location of the listener according to one embodiment.

Turning now to FIG. 5, a method 500 for driving one or more speaker arrays 105 to generate sound with similar or identical direct-to-reverberant ratios at the location of the listener 107 will be discussed. Each operation of the method 500 may be performed by one or more components of the audio source 103 and/or the speaker arrays 105. For example, one or more of the operations of the method 500 may be performed by the rendering strategy unit 209 of the audio source 103.

As noted above, in one embodiment, one or more components of the audio source 103 may be integrated within one or more speaker arrays 105. For example, one of the speaker arrays 105 may be designated as a master speaker array 105. In this embodiment, the operations of the method 500 may be solely or primarily performed by this master speaker array 105 and data generated by the master speaker array 105 may be distributed to other speaker arrays 105.

Although the operations of the method 500 are described and shown in a particular order, in other embodiments, the operations may be performed in a different order. For example, in some embodiments, two or more operations of the method 500 may be performed concurrently or during overlapping time periods.

In one embodiment, the method 500 may commence at operation 501 with the determination of one or more characteristics describing each of the speaker arrays 105. For example, operation 501 may determine the direct-to-reverberant ratio experienced at the location of the listener 107 from sound produced by each speaker array 105. The direct-to-reverberant ratio may be defined as the ratio of sound energy received directly from a speaker array 105 (e.g., sound energy received at the location of the listener 107 without reflection) to sound energy received indirectly from the speaker array 105 (e.g., sound energy received at the location of the listener 107 after reflection in the listening area 101). The direct-to reverberant ratio may be quantified by Equation 1 shown below:

$$\text{Direct-To-Reverberant Ratio} = \frac{DI(f) \times V}{100\pi \times r^2 \times T_{60}(f)} \qquad \text{Equation 1}$$

In this equation, $T_{60}$ (f) is the reverberation time in the listening area 101 at the frequency f, V is the functional volume of the listening area 101, DI(f) is the directivity index of a beam pattern emitted by the speaker array 105 at the frequency f, and r is the distance from the speaker array 105 to the listener 107.

Figure 6:
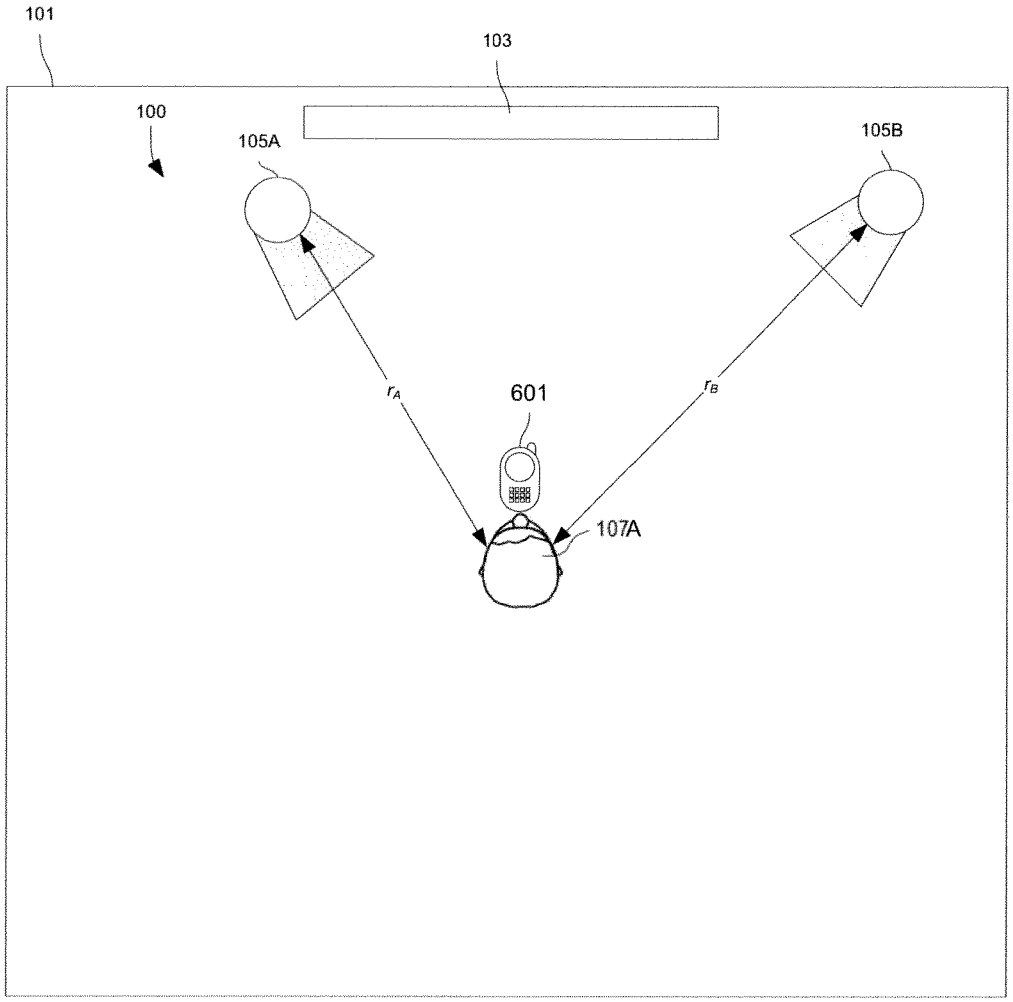
FIG. 6 shows sound produced by multiple speaker arrays sensed by a listening device according to one embodiment.

In one embodiment, operation 501 may be performed by emitting a set of test sounds by one or more of the speaker arrays 105 using different beam pattern types. For example, in the audio system 100 shown in FIG. 1A, the speaker arrays 105A and 105B may be driven with separate test signals and with multiple different beam pattern types. For instance, speaker arrays 105A and 105B may be each sequentially driven with omnidirectional, cardioid, second order, and fourth order beam patterns using a set of test signals. As shown in FIG. 6, sounds from each of the speaker arrays 105 and for each of the beam patterns may be sensed by a listening device 601. The listening device 601 may be any device that is capable of detecting sounds produced by the speaker arrays 105. For example, the listening device 601 may be a mobile device (e.g., a cellular telephone), a laptop computer, a desktop computer, a tablet computer, a personal digital assistant, or any other similar device that is capable of sensing sound. The listening device 601 may include one or more microphones for detecting sound, a processor and memory unit that are similar to the processor 201 and memory unit 203 of the audio source 103, and/or an interface similar to the interface 207 for communicating with the audio source 103 and/or the speaker arrays 105. As noted above, in one embodiment, the listening device 601 may include multiple microphones that operate independently or as one more microphone arrays to detect sound from each of the speaker arrays 105.

In one embodiment, the listening device 601 may be placed proximate to the listener 107 such that the listening device 601 may sense sounds produced by the speaker arrays 105 as they would be heard/sensed by the listener 107. For example, in one embodiment, the listening device 601 may be held near an ear of the listener 107 while operation 501 is being performed. The sounds sensed by the listening device 601 may be analyzed at operation 501 to determine the direct-to-reverberant ratio for each beam pattern produced by each of the speaker arrays 105. For example, operation 501 may compare the level of early sound energy detected for a particular speaker array 105 and beam pattern combination to later sound energy detected for the particular speaker array 105 and beam pattern combination. In this embodiment, since the beam patterns are focused on the listener 107, direct sound will arrive sooner than indirect sound, which must take a longer route to the listener 107 as a result of reflection off walls and other surfaces/objects in the listening area 101. Accordingly, the sensed early energy may represent direct sound energy while energy levels of sound later in time may represent reverberant sound energy.

Table 1 below shows a set of direct energy levels, reverberant energy levels, and direct-to-reverberant ratios that may be detected at the location of the listener 107 based on a set of directivity patterns produced by the speaker array 105A.

TABLE 1

| Beam Pattern Type | Direct Energy Level | Reverberant Energy Level | Direct-to-Reverberant Ratio |
|---|---|---|---|
| Omni-Directional | 6 dB | 15 dB | −9 dB |
| Cardioid | 8 dB | 12.5 dB | −4.5 dB |
| Second Order | 8.5 dB | 11.5 dB | −3 dB |
| Fourth Order | 8.5 dB | 11 dB | −2.5 dB |

Table 2 below shows a set of direct energy levels, reverberant energy levels, and direct-to-reverberant ratios that may be detected at the location of the listener 107 based on a set of directivity patterns produced by the speaker array 105B.

TABLE 2

| Beam Pattern Type | Direct Energy Level | Reverberant Energy Level | Direct-to-Reverberant Ratio |
|---|---|---|---|
| Omni-Directional | 3.5 dB | 15 dB | −11.5 dB |
| Cardioid | 5.5 dB | 12.5 dB | −7 dB |
| Second Order | 6 dB | 11.5 dB | −5.5 dB |
| Fourth Order | 6.5 dB | 11 dB | −4.5 dB |

As shown in Tables 1 and 2, the direct-to-reverberant ratios between each of the speaker arrays 105A and 105B and for each corresponding beam pattern vary. The variance may be attributed to various factors, including differences in distances between each of the speaker arrays 105A and 105B and the listener 107, the different types or arrangement/orientation of transducers 109 used in each of the speaker arrays 105A and 105B, and/or other similar factors. These direct-to-reverberant ratios for each different type of beam pattern and each speaker array 105 may be used to select beam patterns for each of the speaker arrays 105A and 105B as will be described in greater detail below.

Although operation 501 is described above in relation to measurement of particular test sounds, in another embodiment, direct-to-reverberant ratios for multiple beam patterns emitted by the speaker arrays 105A and 105B may be estimated based on the reverberation time of the listening area 101 (e.g., $T_{60}$) and/or the distance between each of the speaker arrays 105 and the listener 107. The reverberation time $T_{60}$ is defined as the time required for the level of sound to drop by 60 dB in the listening area 1. In one embodiment, the listening device 601 is used to measure the reverberation time $T_{60}$ in the listening area 101. The reverberation time $T_{60}$ does not need to be measured at a particular location in the listening area 101 (e.g., the location of the listener 107) or with any particular beam pattern. The reverberation time $T_{60}$ is a property of the listening area 101 and a function of frequency.

The reverberation time $T_{60}$ may be measured using various processes and techniques. In one embodiment, an interrupted noise technique may be used to measure the reverberation time $T_{60}$. In this technique, wide band noise is played and stopped abruptly. With a microphone (e.g., the listening device 601) and an amplifier connected to a set of constant percentage bandwidth filters such as octave band filters, followed by a set of ac-to-dc converters, which may be average or rms detectors, the decay time from the initial level down to −60 dB is measured. It may be difficult to achieve a full 60 dB of decay, and in some embodiments extrapolation from 20 dB or 30 dB of decay may be used. In one embodiment, the measurement may begin after the first 5 dB of decay.

In one embodiment, a transfer function measurement may be used to measure the reverberation time $T_{60}$. In this technique, a stimulus-response system in which a test signal, such as a linear or log sine chirp, a maximum length stimulus signal, or other noise like signal, is measured simultaneously in what is being sent and what is being measured with a microphone (e.g., the listening device 601). The quotient of these two signals is the transfer function. In one embodiment, this transfer function may be made a function of frequency and time and thus is able to make high resolution measurements. The reverberation time $T_{60}$ may be derived from the transfer function. Accuracy may be improved by repeating the measurement sequentially from each of the speaker arrays 105 and each of multiple microphone locations (e.g., locations of the listening device 601) in the listening area 101.

In another embodiment, the reverberation time $T_{60}$ may be estimated based on typical room characteristics dynamics. For example, the audio source 103 and/or the speaker arrays 105 may receive an estimated reverberation time $T_{60}$ from an external device through the interface 107.

In one embodiment, the distance between each of the speaker arrays 105 and the listener 107 may be calculated at operation 501. For example, the distances $r_A$ and $r_B$ may be estimated using various techniques. In one embodiment, the distances $r_A$ and $r_B$ may be determined using 1) a set of test sounds and the listening device 601 through the calculation of propagation delays, 2) a video/still image camera of the listening device 601, which captures the speaker arrays 105 and estimates the distances $r_A$ and $r_B$ based on these captured videos/images, and/or 3) inputs from the listener 107.

Figure 7:
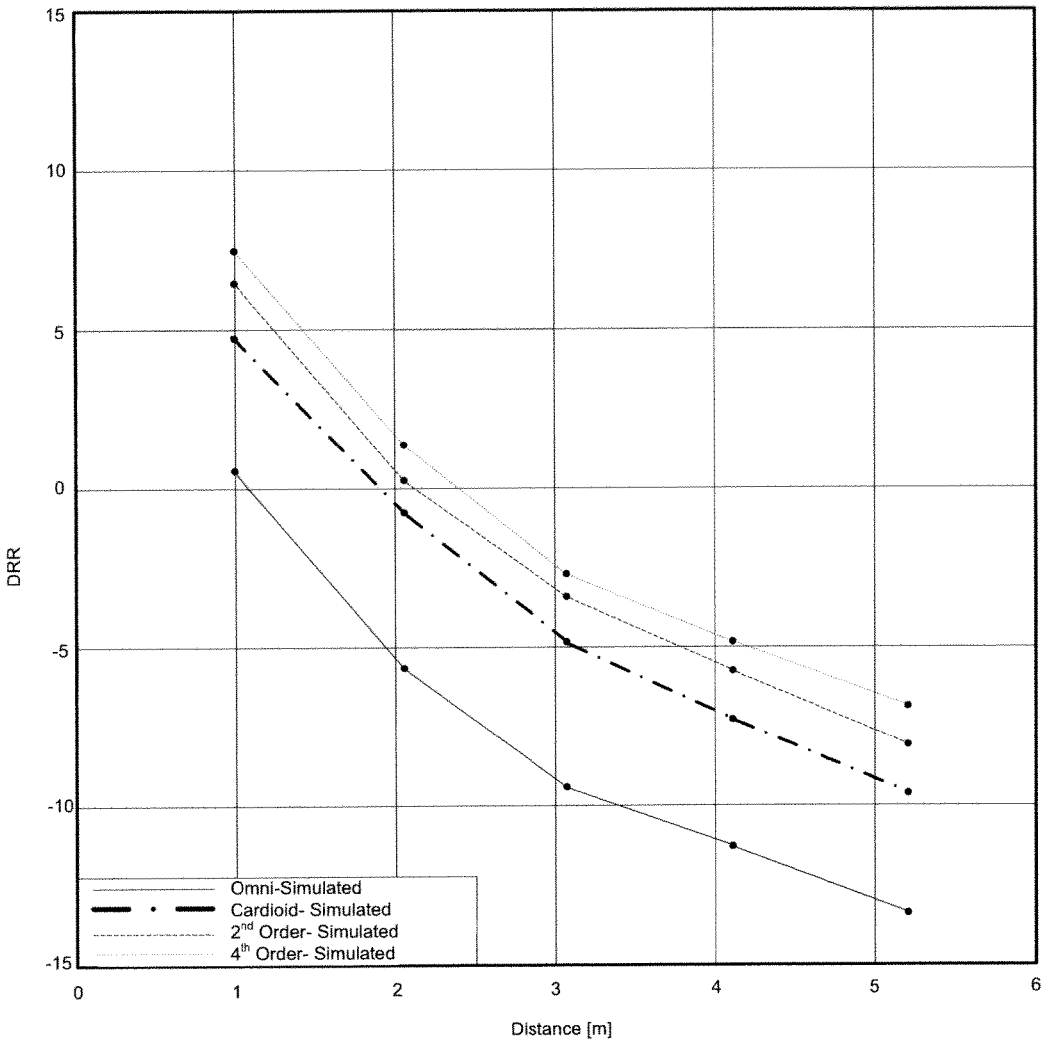
FIG. 7 shows a chart of direct-to-reverberant ratios for a set of beam pattern types in relation to distances between the speaker arrays and a listener according to one embodiment.

Based on the calculated reverberation time $T_{60}$ and/or the distances $r_A$ and $r_B$, operation 501 may estimate the direct-to-reverberant ratios for a set of beam patterns. For example, FIG. 7 shows a chart of direct-to-reverberant ratios for a set of beam pattern types in relation to distances between the speaker arrays 105A and 105B and the listener 107. In one embodiment, the values in the chart shown in FIG. 7 may be retrieved based on the calculated reverberation time $T_{60}$. For example, the values in the chart of FIG. 7 may represent expected direct-to-reverberant ratios based on known distances between a speaker array 105 and a location (e.g., the location of the listener 107) and characteristics of the listening area 101 (e.g., the calculated reverberation time $T_{60}$). This chart may be retrieved from a local data source (e.g., the memory unit 203) or a remote data source that is retrievable using the interface 207 based on the calculated reverberation time $T_{60}$.

In one embodiment, the direct-to-reverberant ratios shown in FIG. 7 may be calculated using Equation 1 listed above, based on the directivity indexes of each beam pattern, the calculated reverberation time $T_{60}$, and the distances $r_A$ and $r_B$.

Accordingly, as described above operation 501 may determine characteristics of the speaker arrays 105, including the direct-to-reverberant ratio experienced at the location of the listener 107 from sound produced by each speaker array 105 using a variety of beam patterns. In one embodiment, the listener 107 may select which technique to use based on a set of user manipulated preferences.

Following operation 501, operation 503 may determine a preferred direct-to-reverberant ratio. The preferred direct-to-reverberant ratio describes the amount of direct sound energy in relation to the reverberant sound energy experienced by the listener 107. In one embodiment, the preferred direct-to-reverberant ratio may be preset by the audio system 100. For example, the manufacturer of the audio source 103 and/or the speaker arrays 105 may indicate a preferred direct-to-reverberant ratio. In another embodiment, the preferred direct-to-reverberant ratio may be relative to the content being played. For example, speech/dialogue may be associated with a high preferred direct-to-reverberant ratio while music may be associated with a comparatively lower preferred direct-to-reverberant ratio. In still another embodiment, the listener 107 may indicate a preference for a preferred direct-to-reverberant ratio through a set of user manipulated preferences.

In yet another embodiment, operation 503 may select the direct-to-reverberant ratio of one of the speaker arrays 105 as the preferred direct-to-reverberant ratio. For example, the speaker array 105A, which is at a distance of three meters from the listener 107 (e.g., $r_A$ is three meters), may be currently emitting a cardioid beam pattern directed at the listener 107. Based on the chart in FIG. 7, the direct-to-reverberant ratio at the location of the listener 107 would be approximately −4.5 dB based on sound produced from the speaker array 105A. In this example, the preferred direct-to-reverberant ratio would be set to −4.5 dB.

In one embodiment, multiple preferred direct-to-reverberant ratios may be determined at operation 503. For example, separate preferred direct-to-reverberant ratios may be calculated for separate types of content (e.g., speech/dialogue, music and effects, etc.). In this embodiment, beam patterns corresponding to a first content type may be associated with a first preferred direct-to-reverberant ratio while beam patterns corresponding to a second content type may be associated with a second preferred direct-to-reverberant ratio. For instance, in the audio system 100 configuration shown in FIG. 1B, the speaker arrays 105A and 105B may emit front left and front right beam patterns, respectively, that include dialogue for a movie. In contrast, the speaker arrays 105C and 105D may emit left surround and right surround beam patterns respectively, that include music and effects for the movie. In this example, the front left and front right beam patterns may be associated with a preferred direct-to-reverberant ratio of 2.0 dB while the left surround and right surround beam patterns speaker arrays 105 may be associated with a preferred direct-to-reverberant ratio of −3.0 dB.

Following the selection of the preferred direct-to-reverberant ratio (or ratios) at operation 503, operation 505 may select a beam pattern for each of the speaker arrays 105 such that the preferred direct-to-reverberant ratio at the listener 107 is achieved by each of the speaker arrays 105. For example, when the preferred direct-to-reverberant ratio is determined at operation 503 to be −4.5 dB and the distances $r_A$ and $r_B$ are determined at operation 501 to be three meters and four meters, respectively, operation 505 may select a cardioid beam pattern for the speaker array 105A and a fourth order beam pattern for the speaker array 105B based on the chart shown in FIG. 7. In particular, as shown in FIG. 7, a cardioid beam pattern at a distance of three meters (i.e., the distance $r_A$) produces a direct-to-reverberant ratio of approximately −4.5 dB while a fourth order beam pattern at a distance of four meters (i.e., the distance $r_B$) produces a direct-to-reverberant ratio of approximately −4.5 dB. Accordingly, a cardioid beam pattern assigned to the speaker array 105A and a fourth order beam pattern assigned to the speaker array 105B will produce an identical direct-to-reverberant ratio for sound produced by each of the arrays 105A and 105B at the location of the listener 107.

In some embodiments, a single speaker array 105 may emit multiple beam patterns corresponding to different channels and/or different types of audio content (e.g., speech/dialogue, music and effects, etc.). In this embodiment, a single speaker array 105 may emit beams to produce separate direct-to-reverberant ratios for each of the channels and/or types of audio content. For example, the speaker array 105A may produce a first beam corresponding to dialogue and a second beam corresponding to music for a piece of sound program content. In this embodiment, preferred direct-to-reverberant ratios may be separately assigned at operation 503 for each of dialogue and music components for the piece of sound program content. Based on these separate preferred direct-to-reverberant ratios, operation 505 may select different beam patterns such that each corresponding preferred direct-to-reverberant ratio is achieved at the location of the listener 107.

Although described above as selecting beam patterns that exactly achieve a preferred direct-to-reverberant ratio, in some embodiments beam patterns may be selected at operation 505 that produce a direct-to-reverberant ratio within a predefined threshold of a preferred direct-to-reverberant ratio. For example, the threshold may be 10% such that a beam pattern is selected that produces sound with a direct-to-reverberant ratio at the location of the listener 107 within 10% of a preferred direct-to-reverberant ratio. In other embodiments, a larger threshold may be used (e.g., 1%-25%).

Following selection of beam patterns at operation 505, operation 507 may drive each of the speaker arrays 105 using the selected beam patterns. For example, a left audio channel may be used to drive the speaker array 105A to produce a cardioid beam pattern while a right audio channel may be used to drive the speaker array 105B to produce a fourth order beam pattern. In one embodiment, the speaker arrays 105 may use one or more of the digital-to-analog converters 217, power amplifiers 211, delay circuits 214, and beamformers 215 for driving transducers 109 to produce the selected beam patterns at operation 507. As noted above, the digital-to-analog converters 217, power amplifiers 211, delay circuits 214, and beamformers 215 may be formed/implemented using any set of hardware circuitry and/or software components. For example, the beamformers 215 may be comprised of a set of finite impulse response (FIR) filters and/or one or more other filters.

In one embodiment, operation 507 may adjust drive settings for one or more of the speaker arrays 105 to ensure the level at the location of the listener 107 from each of the speaker arrays 105 is the same. For instance, in the example provided above in relation to Table 1 and Table 2, the level at the location of the listener 107 based on sound from the speaker array 105A may be 1.5 dB higher than sound from the speaker array 105B. This level difference may be based on a variety of factors, including the distance between the speaker arrays 105A and 105B and the location of the listener 107. In this example, to ensure that the sound level from each of the speaker arrays 105 is the same, operation 507 may apply a 1.5 dB gain to audio signals used to drive the speaker array 105B such that the level of sound at the location of the speaker arrays 105A and 105B is the same. Accordingly, based on this adjustment/application of gain at operation 507 and the selection of beam patterns at operation 505, both the direct-to-reverberant ratio and the level of sound from each of the speaker arrays 105A and 105B at the location of the listener 107 may be identical.

In one embodiment, the beam patterns selected at operation 505 may be transmitted to each corresponding speaker array 105. Accordingly, each of the speaker arrays 105 may receive a selected beam pattern and generate a set of delays and gain values for corresponding transducers 109 such that the selected beam patterns are generated. In other embodiments, the delays, gain values, and other parameters for generating the selected beam patterns may be calculated by the audio source 103 and/or another device and transferred to the speaker arrays 105.

As described above, the method 500 may drive separate speaker arrays 105 to produce sound at the location of the listener 107 with identical or nearly identical direct-to-reverberant ratios. In particular, the direct-to-reverberant ratio perceived by the listener 107 based on sound produced by the speaker array 105A may be identical or nearly identical to the direct-to-reverberant ratio perceived by the listener 107 based on sound produced by the speaker array 105B. By matching direct-to-reverberant ratios for sound produced by multiple speaker arrays 105, the method 500 ensures a more consistent listening experience for the listener 107. In some embodiments, time of arrival, level of sound, and spectrum matching may also be applied to sound produced by multiple speaker arrays 105.

In one embodiment, the method 500 may be run during configuration of the audio system 100. For example, following installation and setup of the audio system 100 in the listening area 101, the method 500 may be performed. The method 500 may be subsequently performed each time one or more of the speaker arrays 105 and/or the listener 107 moves.

Although described in relation to a single listener 107, in other embodiments, the method 500 and the audio system 100 may be similarly applied to multiple listeners 107. For example, in embodiments in which separate beam patterns are generated for separate listeners 107, each set of beam patterns for each set of listeners 107 may be associated with a preferred direct-to-reverberant ratio. Accordingly, each listener 107 may receive sound from corresponding beam patterns such that separate preferred direct-to-reverberant ratios are maintained for each of the listeners 107. In another embodiment, a constant direct-to-reverberant ratio may be maintained for multiple listeners 107 based on individualized beams. For example, an average direct-to-reverberant ratio may be generated by beams across multiple locations/listeners 107 based on sound heard from each of the listeners 107 from each beam.

As explained above, an embodiment of the invention may be an article of manufacture in which a machine-readable medium (such as microelectronic memory) has stored thereon instructions that program one or more data processing components (generically referred to here as a "processor") to perform the operations described above. In other embodiments, some of these operations might be performed by specific hardware components that contain hardwired logic (e.g., dedicated digital filter blocks and state machines). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A method for driving a set of speaker arrays to maintain a preferred direct-to-reverberant ratio for sound emitted by each speaker array at a location of a listener, comprising:

determining, by a programmed processor of an electronic audio source, characteristics for a first speaker array and a second speaker array;

determining, by the programmed processor of the electronic audio source, a preferred direct-to-reverberant ratio for sound emitted by the first speaker array and the second speaker array; and selecting, by the programmed processor of the electronic audio source, a first beam pattern for the first speaker array based on the characteristics of the first speaker array wherein the first speaker array produces the preferred direct-to-reverberant ratio at the location of a listener, and the second speaker array produces the preferred direct-to-reverberant ratio at the location of the listener.

2. The method of claim 1, further comprising:

selecting a second beam pattern for the second speaker array based on the characteristics for the second speaker array such that sound produced by the second speaker array produces the preferred direct-to-reverberant ratio at the location of the listener where the preferred direct-to-reverberant ratio is within 10% from a predefined direct-to-reverberant ratio.

3. The method of claim 1, wherein the preferred direct-to-reverberant ratio is within 10% from the direct-to-reverberant ratio generated by the second speaker array at the location of the listener prior to selecting the first beam pattern.

4. The method of claim 2, wherein determining characteristics for the first speaker array and the second speaker array comprises:

determining a reverberation time of a listening area in which the first and second speaker arrays are located;

determining a distance between the first speaker array and the location of the listener; and determining a distance between the second speaker array and the location of the listener.

5. The method of claim 4, further comprising:

retrieving a set of calculated direct-to-reverberant ratios and corresponding distances at which these calculated direct-to-reverberant ratios are achieved using a plurality of test beam patterns, wherein the set of calculated direct-to-reverberant ratios are associated with the reverberation time of the listening area, wherein the first and second beam patterns are selected from the plurality of test beam patterns, based on the preferred direct-to-reverberant ratio and based on the determined distances between the first and second speaker arrays and the location of the listener.

6. The method of claim 1, wherein determining characteristics for the first speaker array and the second speaker array comprises:

driving each of the first speaker array and the second speaker array to sequentially output sound using a plurality of test beam patterns;

detecting, by a listening device, test sounds generated by each speaker array-beam pattern combination, of the first and second speaker arrays and the plurality of test beam patterns; and determining a test direct-to-reverberant ratio for each said combination, based on the detected sounds.

7. The method of claim 6, further comprising:

determining a first test direct-to-reverberant ratio associated with the first speaker array that is identical to or within a prescribed threshold from a second test direct-to-reverberant ratio associated with the second speaker array, wherein the selected first beam pattern is the beam pattern that generated the first test direct-to-reverberant ratio, and the beam pattern that generated the second test direct-to-reverberant ratio is selected for the second speaker array.

8. The method of claim 2, further comprising:

selecting a gain value to apply to the first speaker array, wherein the gain value allows the level of sound produced by each of the first and second speaker arrays to be identical at the location of the listener;

driving the first speaker array using 1) the first beam pattern, and 2) the gain value to produce the preferred direct-to-reverberant ratio and a preferred sound level at the location of the listener; and driving the second speaker array using the second beam pattern to produce the preferred direct-to-reverberant ratio and the preferred sound level at the location of the listener.

9. The method of claim 2, wherein the first beam pattern and the second beam pattern are one or more of an omni-directional beam pattern, a cardioid beam pattern, a second order beam pattern, and a fourth order beam pattern.

10. A computing device for driving a set of speaker arrays to maintain a preferred direct-to-reverberant ratio for sound emitted by each speaker array at a location of a listener, comprising:

a hardware processor; and a non-transitory memory unit for storing instructions, which when executed by the hardware processor:

determine characteristics for a first speaker array and a second speaker array;

determine a preferred direct-to-reverberant ratio for sound emitted by the first speaker array and the second speaker array; and select a first beam pattern for the first speaker array based on the characteristics for the first speaker array wherein the first speaker array produces the preferred direct-to-reverberant ratio at the location of a listener, and the second speaker array produces the preferred direct-to-reverberant ratio at the location of the listener.

11. The computing device of claim 10, wherein the memory unit includes further instructions which when executed by the hardware processor:

select a second beam pattern for the second speaker array based on the characteristics for the second speaker array such that sound produced by the second speaker array produces the preferred direct-to-reverberant ratio at the location of the listener where the preferred directo-to-reverberant ratio is within 25% from a predefined direct-to-reverberant ratio.

12. The computing device of claim 10, wherein the preferred direct-to-reverberant ratio is within 25% from the direct-to-reverberant ratio generated by the second speaker array at the location of the listener prior to selecting the first beam pattern.

13. The computing device of claim 11, wherein the memory unit includes further instructions which when executed by the hardware processor:

determine a reverberation time of a listening area in which the first and second speaker arrays are located;

determine a distance between the first speaker array and the location of the listener; and determine a distance between the second speaker array and the location of the listener.

14. The computing device of claim 13, wherein the memory unit includes further instructions which when executed by the hardware processor:

retrieve a set of calculated direct-to-reverberant ratios and corresponding distances at which these calculated direct-to-reverberant ratios are achieved using a plurality of test beam patterns, wherein the set of calculated direct-to-reverberant ratios are associated with the reverberation time of the listening area, wherein the first and second beam patterns are selected from the plurality of test beam patterns, based on the preferred direct-to-reverberant ratio and based on the determined distances between the first and second speaker arrays and the location of the listener.

15. The computing device of claim 10, wherein the memory unit includes further instructions which when executed by the hardware processor:

drive each of the first speaker array and the second speaker array to sequentially output sound using a plurality of test beam patterns;

detect, by a listening device, test sounds generated by each speaker array-beam pattern combination of the first and second speaker arrays and the plurality of test beam patterns; and determine a test direct-to-reverberant ratio for each said based on the detected sounds.

16. The computing device of claim 15, wherein the memory unit includes further instructions which when executed by the hardware processor:

determine a first test direct-to-reverberant ratio associated with the first speaker array that is identical to or within a prescribed threshold from a second test direct-to-reverberant ratio associated with the second speaker array, wherein the selected first beam pattern is the beam pattern that generated the first test direct-to-reverberant ratio, and the beam pattern that generated the second test direct-to-reverberant ratio is selected for the second speaker array.

17. The computing device of claim 11, wherein the memory unit includes further instructions which when executed by the hardware processor:

select a gain value to apply to the first speaker array, wherein the gain value allows the level of sound produced by each of the first and second speaker arrays to be identical at the location of the listener;

drive the first speaker array using 1) the first beam pattern, and 2) the gain value to produce the preferred direct-to-reverberant ratio and a preferred sound level at the location of the listener; and drive the second speaker array using the second beam pattern to produce the preferred direct-to-reverberant ratio and the preferred sound level at the location of the listener.

18. The computing device of claim 16, wherein the first and second speaker arrays are integrated within the computing device.

19. An article of manufacture for driving a set of speaker arrays to maintain a preferred direct-to-reverberant ratio for sound emitted by each speaker array at the location of a listener, comprising:

a non-transitory machine-readable storage medium that stores instructions which, when executed by a processor in a computer, determine characteristics for a first speaker array and a second speaker array;

determine a preferred direct-to-reverberant ratio for sound emitted by the first speaker array and the second speaker array; and select a first beam pattern for the first speaker array based on the characteristics for the first speaker array wherein the first speaker array produces the preferred direct-to-reverberant ratio at the location of a listener, and the second speaker array produces the preferred direct-to-reverberant ratio at the location of the listener.

20. The article of manufacture of claim 19, wherein the non-transitory machine-readable storage medium stores further instructions which, when executed by the processor:

select a second beam pattern for the second speaker array based on the characteristics for the second speaker array such that sound produced by the second speaker array produces the preferred direct-to-reverberant ratio at the location of the listener.

21. The article of manufacture of claim 19, wherein the preferred direct-to-reverberant ratio is within 15% from the direct-to-reverberant ratio generated by the second speaker array at the location of the listener prior to selecting the first beam pattern.

22. The article of manufacture of claim 20, wherein the non-transitory machine-readable storage medium stores further instructions which, when executed by the processor:

determine a reverberation time of a listening area in which the first and second speaker arrays are located;

determine a distance between the first speaker array and the location of the listener; and determine a distance between the second speaker array and the location of the listener.

23. The article of manufacture of claim 22, wherein the non-transitory machine-readable storage medium stores further instructions which, when executed by the processor:

retrieve a set of calculated direct-to-reverberant ratios and corresponding distances at which these calculated direct-to-reverberant ratios are achieved using a plurality of test beam patterns, wherein the set of calculated direct-to-reverberant ratios are associated with the reverberation time of the listening area, wherein the first and second beam patterns are selected from the plurality of test beam patterns, based on the preferred direct-to-reverberant ratio and the determined distances between the first and second speaker arrays and the location of the listener.

24. The article of manufacture of claim 19, wherein the non-transitory machine-readable storage medium stores further instructions which, when executed by the processor:

drive each of the first speaker array and the second speaker array to sequentially output sound using a plurality of test beam patterns;

detect, by a listening device, test sounds generated by each combination of the first and second speaker arrays and the plurality of test beam patterns; and determine a test direct-to-reverberant ratio for each combination of 1) the first and second speaker arrays and 2) the plurality of test beam patterns based on the detected sounds.

25. The article of manufacture of claim 24, wherein the non-transitory machine-readable storage medium stores further instructions which, when executed by the processor:

determine a first test direct-to-reverberant ratio associated with the first speaker array that is identical to or within a prescribed threshold from a second test direct-to-reverberant ratio associated with the second speaker array, wherein the preferred direct-to-reverberant ratio is set based on the first test direct-to-reverberant ratio.

26. The article of manufacture of claim 25, wherein the selected first beam pattern is the beam pattern that generated the first test direct-to-reverberant ratio and the beam pattern that generated the second test direct-to-reverberant ratio is selected for the second speaker array.

27. The article of manufacture of claim 19, wherein the non-transitory machine-readable storage medium stores further instructions which, when we executed by the processor are such that the preferred direct-to-reverberant ratio is within 15% from a predefined direct-to-reverberant ratio.

* * * * *